US006303507B1

(12) United States Patent
Wang et al.

(10) Patent No.: US 6,303,507 B1
(45) Date of Patent: Oct. 16, 2001

(54) IN-SITU FEEDBACK SYSTEM FOR LOCALIZED CMP THICKNESS CONTROL

(75) Inventors: Weizhong Wang; Jayendra D. Bhakta, both of Sunnyvale, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/487,180

(22) Filed: Jan. 19, 2000

Related U.S. Application Data

(60) Provisional application No. 60/170,349, filed on Dec. 13, 1999.

(51) Int. Cl.[7] ..... H01L 21/302

(52) U.S. Cl. ..... 438/692; 156/345; 451/287

(58) Field of Search ..... 438/690, 691, 438/692, 693; 451/6, 7, 285–289; 156/345

(56) References Cited

U.S. PATENT DOCUMENTS

| | | | |
|---|---|---|---|
| 5,234,867 | 8/1993 | Schultz et al. | 437/225 |
| 5,459,570 | 10/1995 | Swanson et al. | 356/345 |
| 5,471,303 | 11/1995 | Ai et al. | 356/357 |
| 5,551,986 | 9/1996 | Jain | 134/6 |
| 5,599,423 | 2/1997 | Parker et al. | 156/636.1 |
| 5,624,299 | 4/1997 | Shendon | 451/28 |
| 5,672,095 | 9/1997 | Morimoto et al. | 451/41 |
| 5,711,818 | 1/1998 | Jain | 134/6 |
| 5,792,709 | 8/1998 | Robinson et al. | 438/692 |
| 5,842,912 | 12/1998 | Holzapfel et al. | 451/72 |
| 5,944,582 | 8/1999 | Talich | 451/41 |
| 5,964,643 * | 10/1999 | Birang et al. | 451/6 |
| 6,093,081 * | 7/2000 | Nyui et al. | 451/6 |
| 6,179,956 * | 1/2001 | Nagahara et al. | 156/345 |

* cited by examiner

*Primary Examiner*—Benjamin L. Utech
*Assistant Examiner*—Kin-Chan Chen

(57) ABSTRACT

To attenuate a CMP polishing rate differential which tends to occur over the surface of a semiconductor substrate surface which has had one or more layers formed thereon, surface characteristics of the upper surface which are representative of the thickness, for example, of a layer which is being removed either in part or in its entirety, are monitored and surface profile information is developed using a suitable algorithm and used to control the timing with which force is applied by one or more of a plurality of actuators disposed on the other side of the wafer, in a manner wherein areas which have undergone more removal than others, are forced into contact with the polishing pad with a force which is reduced as compared that which is applied to localized high areas wherein a lesser amount of the layer has been removed.

5 Claims, 2 Drawing Sheets

IN-SITU FEEDBACK SYSTEM FOR LOCALIZED CMP THICKNESS CONTROL

CROSS REFERENCE TO RELATED APPLICATION

This application claims priority from Provisional Patent Application Ser. No. 60/170,349 filed on Dec. 13, 1999, entitled IN-SITU FEEDBACK SYSTEM FOR LOCALIZED CMP THICKNESS CONTROL. The content of this Provisional Patent Application is hereby incorporated by reference thereto.

BACKGROUND OF THE INVENTION

1. Field of the Invention

The present invention relates generally to a chemical-mechanical polishing (CMP) process and more specifically to a process wherein the rate of polishing at different locations on the wafer is monitored and the force which is applied between the pad and wafer is varied in a timed relationship with the effects of the CMP in a manner to reduce the polishing differential and to increase the flatness of the layer(s) on the upper surface of wafer.

2. Description of the Related Art

CMP is a method of planarizing or polishing semiconductor and other types of substrates. At certain stages in the fabrication of devices on a substrate, it becomes necessary to polish the surface of the substrate before further processing may be performed. One polishing process, which passes a conformable polishing pad over the surface of the substrate to perform the polishing, is commonly referred to as mechanical polishing. Mechanical polishing may also be performed with a chemically active abrasive slurry, which typically provides a higher material removal rate, and a higher chemical selectivity between films of the semiconductor substrate, than is possible with mechanical polishing. When a chemical slurry is used in combination with mechanical polishing, the process is commonly referred to as CMP.

One prior art CMP process is disclosed in U.S. Pat. No. 5,234,867, Schultz. That process generally includes the steps of rotating a polishing pad which has a diameter several times larger than a substrate, pouring a chemical slurry on the rotating polishing pad, and placing a substrate on the rotating polishing pad and independently rotating the substrate while maintaining pressure between the rotating polishing pad and the substrate. The polishing pad is held on a relatively massive planer platen which is coupled to a motor. The motor rotates the platen and polishing pad, and the platen provides a flat surface to support the rotating polishing pad. To independently rotate the substrate, it may be located within a separate rotating polishing head or carrier, which is also moveable in an x-y plane to locate the substrate rotating therein in specific positions on the large, rotating platen. As the polishing pad is several times larger than the substrate, the substrate may be moved from the outer diameter to the center of the rotating polishing pad during processing.

The rate of material removed from the substrate in CMP is dependent on several factors, including among others, the chemicals and abrasives used in the slurry, the surface pressure at the polishing pad/substrate interface, the net motion between the substrate and polishing pad at each point on the substrate. Generally, the higher the surface pressure, and net motion at the regions of the substrate which contact the polishing pad, the greater the rate of material removed from the substrate. In Schultz, '867, the removal rate across the substrate is controlled by providing an irregularly-shaped polishing pad, and rotating the substrate and polishing pad to attempt to create an equal "residence time" of the polishing pad against all areas of the substrate, and in one embodiment thereof, by also varying the pressure at the substrate/polishing pad interface.

Using a large rotating polishing pad for CMP processing has several additional processing limitations which lead to non-uniformities in the polished substrate. Because the entire substrate is rotated against the polishing pad, the entire surface of the substrate is polished to a high degree of flatness as measured across the diameter of the substrate. Where the substrate is warped, the portions of the substrate which project upwardly due to warpage tend to have higher material removal rates than the remainder of the substrate surface. Further, as the polishing pad polishes the substrate, material removed from the substrate forms particulate which may become trapped in the pad, and the polishing slurry dries on the pad. When the pad becomes filled with particulates and the slurry dries in the pad, the polishing surface of the pad glazes and its polishing characteristics change. Unless the user constantly monitors the removal rate of the polishing pad with each substrate, or group of substrates, and adjusts the slurry, load, position, and/or rotation speed of the polishing pad or substrate to maintain the desired material removal rate, the amount of material removed by the polishing pad from each substrate consecutively processed thereon will decrease.

In an effort to overcome the above drawbacks, it has been proposed in U.S. Pat. No. 5,944,582 issued on Aug. 31, 1999 in the name of Talieh, to polish substrates using an arrangement wherein the polishing pad is no larger than, and is preferably substantially smaller than, the radius of the substrate being polished. In one arrangement disclosed in this reference, the apparatus includes a rotating plate on which a substrate is held, and a polishing arm, which is located adjacent the plate, is moved across the surface of the substrate as the substrate rotates on the rotating plate. The polishing arm includes a polishing pad on the end thereof, which is preferably variably loadable against the surface of the substrate as different areas of the substrate are polished thereby. The speed of rotation of the substrate may be varied, in conjunction with, or independently of, any adjustment in the load of the polishing pad against the substrate to control the rate of material removed by the polishing pad as it crosses the substrate.

However, even with this arrangement a problem occurs in that the chemical effects and the mechanical effects of the polishing are not the same and vary in a manner which causes a relatively large variation in polishing rate from place to place on a wafer surface. This variation can, for example in the case of controlling the thickness of a dielectric layer affects interconnection capacitance and thus circuit performance. However, at this time, it is extremely difficult to achieve planar uniformity across a wafer.

SUMMARY OF THE INVENTION

In order to overcome the above drawback and to attenuate the CMP polishing rate differential which tends to occur over the surface of a semiconductor substrate surface which has had one or more layers formed thereon, surface characteristics of the upper surface which are representative of thickness, for example, of a layer which is being removed either in part or in its entirety, are monitored and surface profile information is developed using a suitable algorithm.

This algorithm enables the force applied by one or more of a plurality of actuators disposed on the other side of the wafer, to be timely controlled in a manner that enables areas which have undergone more removal than others, to be forced into contact with the polishing pad with a force which is reduced as compared that which is applied to localized high areas wherein a lesser amount of the layer has been removed.

More specifically, a first aspect of the present invention resides in a method of CMP a substrate adapted for semiconductor fabrication, comprising: disposing a wafer on a rotatable pedestal; monitoring predetermined surface characteristics of the wafer as the wafer rotates; applying a rotating polishing pad having a diameter less than the wafer to the surface of the wafer while supplying a polishing liquid or slurry to a surface of the polishing pad; determining deviations in polishing rate using the data gleaned from the surface characteristic monitoring; applying force either directly and indirectly to a surface of the wafer opposite to that which is being polished at a plurality of separate, spaced sites; and controlling the force applied at each of the sites, in response to the determined deviations, to vary the polishing rate of the surface of the wafer and to unify the effect of the polishing across the surface of the wafer.

The above mentioned wafer can have at least one layer formed thereon which requires planarization or thickness reduction, and wherein the step of monitoring predetermined surface characteristics comprises using informatory. This inferometry of course can comprises laser/visible light inferometry. Alternate forms of thickness detection can be used provided that they exhibit sufficiently fast response characteristics.

The above-mentioned step of applying force comprises the steps of: disposing a plurality of electrically controlled actuators below the wafer so that at least one actuator is disposed at one of the plurality of separate spaced sites; actuating the actuators to selectively apply force to the wafer in a manner which modifies the abrasion between an upper surface of the wafer and the rotating polishing pad.

A second aspect of the present invention resides in a CMP system, comprising: a rotatable pedestal for supporting a wafer adapted for semiconductor fabrication; means for monitoring predetermined surface characteristics of the wafer as the wafer rotates; means for applying a rotating polishing pad having a diameter less than the wafer, to the surface of the wafer while supplying a polishing liquid or slurry to a surface of the polishing pad in contact with the wafer; means for determining polishing rate deviations using the data gleaned from the surface characteristic monitoring means; means for applying force to a surface of the wafer opposite to that which is being polished at a plurality of separate, spaced sites; and means for controlling the force at each of the sites, in response to the determined polishing rate deviations, to vary the polishing rate of the surface of the wafer and to unify the effect of the polishing across the surface of the wafer.

In accordance with this aspect of the invention, the predetermined surface characteristic monitoring means comprises a plurality of sensors which are arranged in an array with respect to the wafer surface. These sensors can comprise inferometry sensors. The force applying means, on the other hand, comprises a plurality of actuators at least one of which is disposed at each of the plurality of separate, spaced sites. These actuators can be electrically controlled and/or electrically responsive devices.

A further aspect of the invention resides in a method of chemical mechanical polishing a substrate, comprising the steps of: disposing a substrate suitable for integrated circuit fabrication on a member; retaining the substrate in a predetermined position of the rotatable member; rotating the rotatable member; positioning a polishing pad having a surface area less than an upper surface of the substrate, on the upper surface of the substrate; rotating the polishing pad; selectively supplying a chemically reactive liquid to a specific area between the substrate and the polishing pad through the polishing pad; moving the polishing pad across the rotating upper surface of the substrate between an edge and a center of the substrate to polish the substrate; monitoring surface profile characteristics of the substrate as it rotates using a sensor arrangement; selectively applying force at a plurality of spaced sites to one of the rotating member and the substrate in accordance with the surface profile characteristics as detected by the sensor arrangement in a manner to reduce the polishing rate differential which occurs between the polishing pad and the upper surface of the substrate.

A yet further aspect of the invention resides in an apparatus for chemical mechanical polishing a substrate, comprising: a rotatable member for holding and rotating the substrate; a rotatable polishing arm connected to the polishing pad rotate the polishing pad and to move the polishing pad across a rotating upper surface of the substrate, the polishing pad having a diameter no larger than a radius of the substrate; sensor array means disposed with respect to the upper surface of the rotating substrate to detect a parameter which varies with surface profile of the substrate or a layer formed thereon; a plurality of actuators disposed so as to apply force to a plurality of separate spaced sites on one of the rotatable member and the substrate; and control circuit means for processing signals which are produced by the sensor array means and producing control signals which are supplied to the plurality of actuators.

The foregoing and other features, aspects and advantages of the present invention will become apparent from the following detailed description of the present invention when taken in conjunction with the accompanying drawings.

BRIEF DESCRIPTION OF THE DRAWINGS

The various aspects and advantages of the present invention will become better understood as a description of the preferred embodiments is given with reference to the appended drawings in which.

DETAILED DESCRIPTION OF THE PREFERRED EMBODIMENTS

Figure 1:
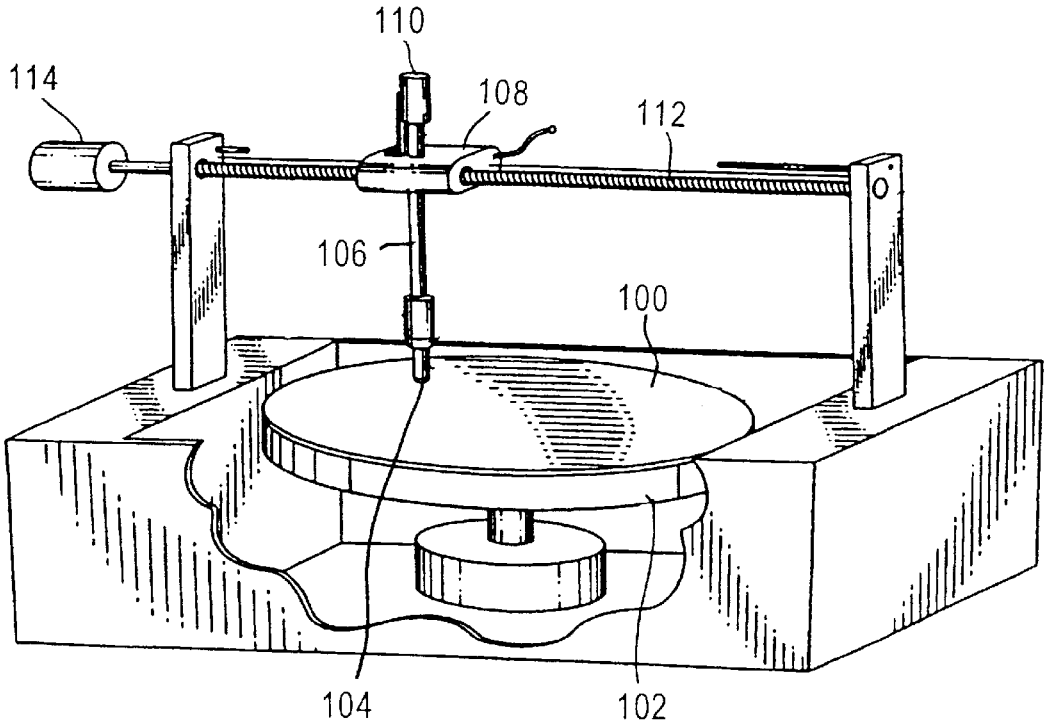
FIG. 1 is a perspective view of a first type of polishing arrangement to which the present invention is applicable.
Figure 2:
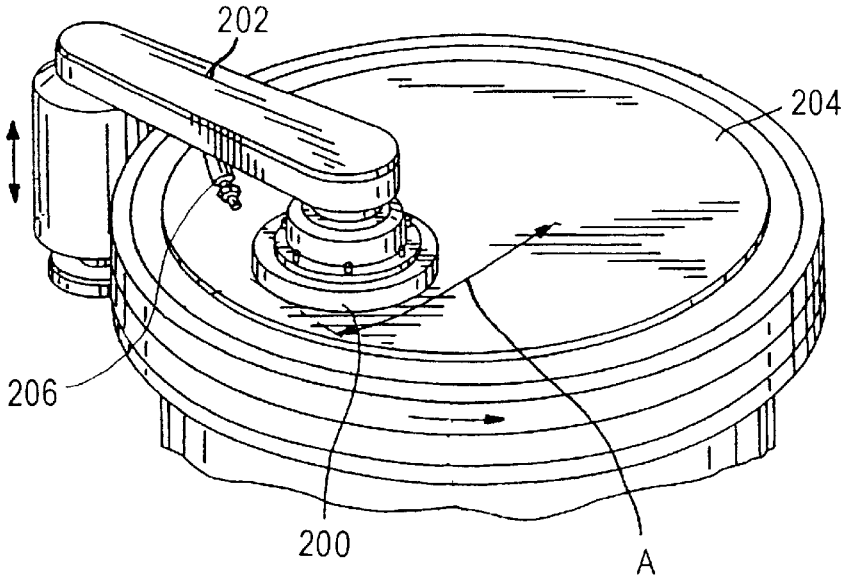
FIG. 2 is a perspective view showing a second type of arrangement via which a wafer can be polished using a small pad of the type to which the present invention is applicable.

FIGS. 1 and 2 show CMP arrangements of the type to which the present invention can be applied. In the FIG. 1 arrangement, the wafer 100 is supported on a turntable 102 and held in place by a vacuum clutch or the like (not shown). The polishing pad 104 in this arrangement is provided at the lower end of a rotatable motor driven shaft 106. A carriage 108, on which a motor 110 which drives the shaft 106 is mounted and through which the shaft 106 is journaled, is mounted on a threaded shaft 112 which is operatively connected to a motor 114 and which is used to induce lateral translation of the carriage 108. The line along which polishing pad 104 is moved with respect to the surface of the wafer 100 by this arrangement is tangential with respect to the axis about which the wafer 100 is rotated.

FIG. 2 shows a second arrangement wherein the polishing pad 200 is mounted on an arm 202 which can swung back and forth across the face of the wafer 204 in the manner indicated by arrow A. As will be appreciated, this path along which the polishing pad 200 is moved with respect to the rotating wafer, is arcuate. A nozzle 206 used to deliver slurry to the surface of the wafer undergoing 204 the polishing action, is supported on the underside of the arm 202.

Figure 3:
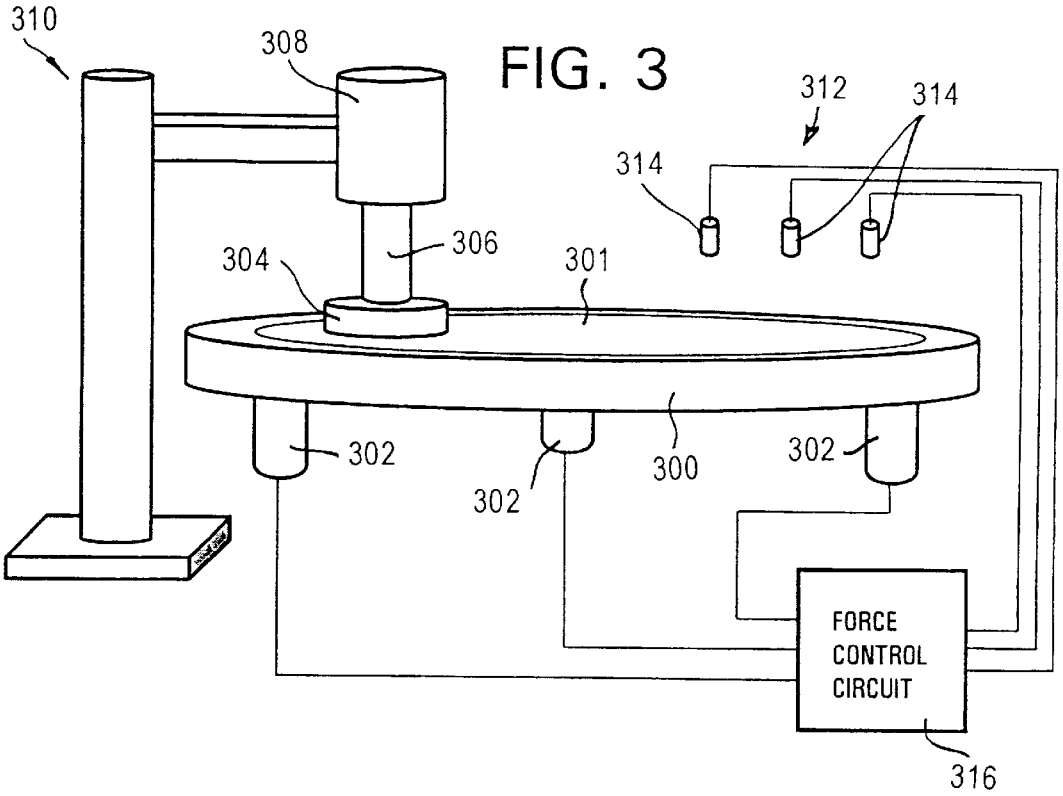
FIG. 3 is a schematic diagram showing the disposition of force applying actuators below the wafer and a sensor array which is disposed above the wafer surface so as to monitor surface characteristics/parameters and enable the amount of polishing to be selectively controlled, in accordance with the present invention.
Figure 4:
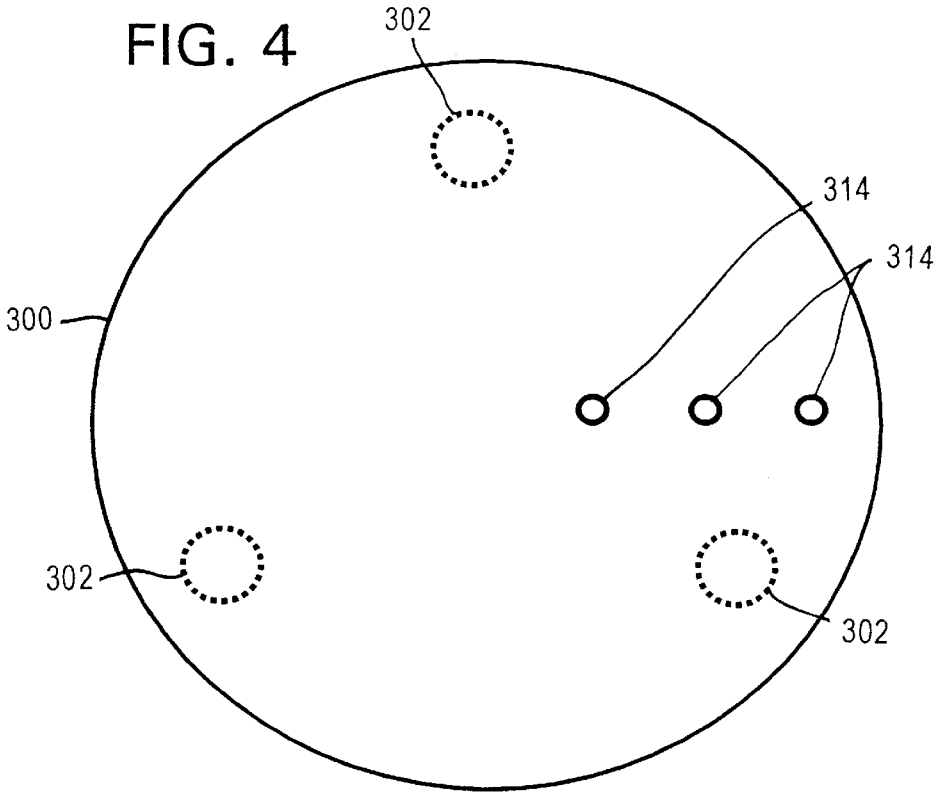
FIG. 4 is a plan view showing the locations of the sensor array and the force controlling actuators which are operatively connected therewith.

FIGS. 3 and 4, schematically show an arrangement which includes a sensor and actuator arrangement according to the present invention. As will be appreciated, these figures are highly schematic and do not show the motor arrangement which is arranged to rotate the turntable 300 on which a wafer 301 is supported and retained in position using a suitable clamping arrangement such as a vacuum clutch. Located below the wafer 301 are a plurality of (3) actuators 302 which exhibit very short response times and are capable of varying the force with which the wafer 301 is pressed up into contact with the polishing pad 304 which is mounted at the bottom of a shaft 306 which is operatively connected with a motor 308.

In this illustration, the motor 308 and shaft 306 are shown as being supported by a support arrangement 310 which is disposed adjacent the turntable 200. This structure enables the pad 304 to be moved across the surface of the wafer while a suitable amount of slurry is supplied to the surface of the wafer 301.

Located above the wafer 301 is an array of sensors 312. In this arrangement, the sensor array includes three sensors 314 which in this embodiment are three inferometers which are arranged to produce data signals indicative of the highs and lows which are present on the wafer surface. A control circuit 316 which is operatively connected with the sensors 314 not only controls the operation thereof, but also processes the information gleaned from the sensor array 312 to produce information indicative of a surface profile of the wafer 301.

The control circuit 316 includes a process or processors which are adapted to generate and process the data inputs from the sensors 314 and develop a surface profile of the wafer in a manner which allows the force, which is applied by the actuators 302 against the lower surface of the wafer 301, to be controlled in a manner wherein when a high portion is determined by an algorithm to be approaching the position in which the pad 304 will be located after the lapse of given amount of time (which takes the response characteristics of the actuators into account), the amount of force which is applied is increased to the appropriate actuator or actuators with a timing which is so selected that that high area will be pressed against the pad with a force which will cause it undergo more material removal than an adjacent low portion. Conversely, if a low area of sufficient size is detected the amount of force which is adapted to bias the wafer into contact with the pad can be reduced. The diameter of the pad 304 is, of course, an important factor in determining its effective surface area.

With this type of control the amount of material which is removed is increased when a high spot passes under the polishing pad and reduced when a low passes thereunder. However, as will be appreciated, due to the movement of the pad 304 with respect to the wafer 301 and the rotation of the wafer 301 with respect to the pad 304, it is necessary to very quickly determined that a high spot is heading toward a position which will be occupied by the pad 304 after the lapse of a predetermined short amount of time. Further, in the event that the sensors 312 which are used, take the form of inferometers, it will be necessary to screen the data to remove noise and the like which results from the presence of possible remnant slurry. U.S. Pat. No. 5,471,303, issued on Nov. 28, 1995 in the name of Ai et al., discloses a surface profile measurement arrangement which could be used in connection with or as the sensor array. The disclosure of this reference is incorporated by reference thereto.

The actuators 302 which are used are not limited to three and more can be used as required/permissible. As alluded to above, the speed at which the information which is provided by the sensor array must be processed and a decision as to the force which each actuator is to momentarily apply and to take into consideration in the lag in response to control signals which are issued thereto must be taken into account. As the number of actuators increases the decision making process must be adapted to allow for the correct actuator to be correctly energized.

A further variable which is possible with the present invention resides in whether the actuators 302 are arranged to rotate with the carrier (turntable 300) on which the wafer 301 is supported, or are arranged to be stationary with respect thereto and to apply force through suitable low friction roller bearings or the like. The algorithm which controls the actuators 302 must of course take this variable into consideration.

The use of three actuators 302 has an advantage that they can be controlled to define the three points on which a flat plane lies. By varying the orientation of the plane it is possible to vary the orientation of the wafer 301 without imparting localized stress therein during polishing. In the event that the diameter of the polishing pad 304 is small similar to the arrangement shown in FIG. 1, the tilting of the plane of the wafer will have little effect on the highs and lows. However, as the diameter of the pad 304 increases this tiling of the wafer must be mitigated with the effect wherein one edge of the pad will be relatively lower than the other and thus invite a scoring action. Alternatively, this feature could be used to effect localized material removal in the event that the pad can be maneuvered to a position wherein a high spot will pass under the lower edge of the pad.

While the present invention has been disclosed with reference to only a limited number of embodiments, the various modifications and changes which are possible without departing from the scope of the claims which are set forth hereinafter, will be self evident to a person skilled in the art of semiconductor production and polishing. For example, the number of sensor which are used in the sensor array is not limited to three and any number can be used as desired. Further, the sensors are not limited to inferometers and the use of other sensor arrangements including capacitance or dielectric constant sensors can be used to provide the required information necessary to enable the appropriate control of the actuators. Further, in order to provide the required response the use of piezoelectric and/or electromagnetic elements can be deemed to be within the purview of the claimed invention.

Although the present invention has been described and illustrated in detail, it is to be clearly understood that the same is by way of illustration and example only and is not to be taken by way of limitation, the scope of the present invention being limited only by the terms of the appended claims.

What is claimed is:

1. A method of chemical mechanical polishing a substrate adapted for semiconductor fabrication, the method comprising:

disposing a wafer on a rotatable pedestal;

monitoring surface characteristics of the wafer as the wafer rotates;

applying a rotating polishing pad having a diameter less than the wafer to the surface of the wafer while supplying a polishing liquid or slurry to a surface of the polishing pad;

determining deviations in polishing rate using the data gleaned from the surface characteristic monitoring;

applying force to a surface of the wafer opposite to that which is being polished at a plurality of separate, spaced sites; and controlling the force applied at each of the sites, in response to the determined deviations, to vary the polishing rate of the surface of the wafer and to unify the effect of the polishing across the surface of the wafer.

2. A method as set forth in claim 1, wherein the wafer has at least one layer formed thereon; the method comprising of monitoring the surface characteristics by inferometry.

3. A method as set forth in claim 1, wherein monitoring by inferometry comprises using laser/visible light inferometry.

4. A method as in claim 1, comprising:

disposing the substrate suitable for integrated circuit fabrication on a member;

retaining the substrate in a position of the rotatable member;

rotating the rotatable member;

positioning the polishing pad having a surface area less than an upper surface of the substrate, on the upper surface of the substrate;

rotating the polishing pad;

selectively supplying a chemically reactive liquid to a specific area between the substrate and the polishing pad through the polishing pad;

moving the polishing pad across the rotating upper surface of the substrate between an edge and a center of the substrate to polish the substrate;

monitoring surface profile characteristics of the substrate as it rotates using a sensor arrangement; and selectively applying force at a plurality of spaced sites to one of the rotating member and the substrate in accordance with the surface profile characteristics as detected by the sensor arrangement in a manner to reduce the polishing rate differential which occurs between the polishing pad and the upper surface of the substrate.

5. A method of chemical mechanical polishing a substrate adapted for semiconductor fabrication, the method comprising:

disposing a wafer on a rotatable pedestal;

monitoring surface characteristics of the wafer as the wafer rotates;

applying a rotating polishing pad having a diameter less than the wafer to the surface of the wafer while supplying a polishing liquid or slurry to a surface of the polishing pad;

determining deviations in polishing rate using the data gleaned from the surface characteristic monitoring;

applying force to a surface of the wafer opposite to that which is being polished at a plurality of separate, spaced sites; and controlling the force applied at each of the sites, in response to the determined deviations, to vary the polishing rate of the surface of the wafer and to unify the effect of the polishing across the surface of the wafer, wherein said applying the force includes:

disposing a plurality of electrically controlled actuators below the wafer so that at least one actuator is disposed at one of the plurality of separate spaced sites; and actuating the actuators to selectively apply force to the wafer in a manner which modifies the abrasion between an upper surface of the wafer and the rotating polishing pad.

* * * * *